US007261052B1

(12) United States Patent
Holmes

(10) Patent No.: US 7,261,052 B1
(45) Date of Patent: Aug. 28, 2007

(54) WAY-GUIDANCE MARKER

(76) Inventor: Paul R. Holmes, 5034 Providence Rd., Charlotte, NC (US) 28226

( * ) Notice: Subject to any disclaimer, the term of this patent is extended or adjusted under 35 U.S.C. 154(b) by 0 days.

(21) Appl. No.: 11/268,024

(22) Filed: Nov. 7, 2005

Related U.S. Application Data

(60) Provisional application No. 60/628,896, filed on Nov. 17, 2004.

(51) Int. Cl.
*F21S 10/00* (2006.01)

(52) U.S. Cl. ..... 116/205; 116/202; 116/209

(58) Field of Classification Search ..... 116/200, 116/202, 205, 209, DIG. 15, DIG. 16; 16/4, 16/6, 8, 17.1; 24/573.09, 578.13; 40/1.5, 40/661.04, 658, 662
See application file for complete search history.

(56) References Cited

U.S. PATENT DOCUMENTS

| | | | | | |
|---|---|---|---|---|---|
| 778,287 | A | * | 12/1904 | Buren | 16/8 |
| 865,102 | A | * | 9/1907 | Huntley | 24/706.4 |
| 3,494,006 | A | | 2/1970 | Brumlik | |
| 3,595,201 | A | * | 7/1971 | Oudenhoven | 116/200 |
| 3,636,913 | A | * | 1/1972 | O'Brien | 116/209 |
| 3,685,482 | A | * | 8/1972 | Ryder | 116/209 |
| 3,927,443 | A | | 12/1975 | Brumlik | |
| 3,991,534 | A | | 11/1976 | Brumlik | |
| 4,385,586 | A | * | 5/1983 | Schriever | 116/205 |
| 4,401,050 | A | | 8/1983 | Britt et al. | |
| 4,597,206 | A | * | 7/1986 | Benson | 40/1.5 |
| 5,309,863 | A | * | 5/1994 | Leeb, Jr. | 116/205 |
| 5,369,899 | A | * | 12/1994 | Reeves | 40/1.5 |
| 5,568,785 | A | * | 10/1996 | Hazen | 116/209 |
| 5,724,909 | A | | 3/1998 | Pitman et al. | |
| 5,724,910 | A | * | 3/1998 | Annesley et al. | 116/209 |
| 5,764,060 | A | * | 6/1998 | Gonzalez et al. | 116/205 |
| 5,771,835 | A | * | 6/1998 | Schneider | 116/209 |
| 5,775,016 | A | | 7/1998 | Chien | |
| 6,025,773 | A | | 2/2000 | Bresnan | |
| 6,276,634 | B1 | | 8/2001 | Bodle | |
| 6,307,207 | B1 | | 10/2001 | Burbank | |
| 6,385,812 | B1 | * | 5/2002 | Iverson | 16/4 |
| 6,658,773 | B2 | * | 12/2003 | Rohne et al. | 40/542 |
| 2001/0049894 | A1 | | 12/2001 | Ingraham | |
| 2002/0046692 | A1 | * | 4/2002 | Pharo et al. | 116/200 |
| 2003/0029372 | A1 | | 2/2003 | Moore | |
| 2006/0245827 | A1 | * | 11/2006 | Rydin et al. | 116/205 |

* cited by examiner

*Primary Examiner*—G. Bradley Bennett
*Assistant Examiner*—Travis Reis
(74) *Attorney, Agent, or Firm*—Trego, Hines & Ladenheim, PLLC

(57) ABSTRACT

A guidance marker for utilization with a fibrous web surface and providing an individual with a safe egress to an exit. The guidance marker includes a base carrying an indicator surface and at least one lock pin. The indicator surface is identifiable in the absence of normal lighting. The lock pin secures the base to the fibrous web surface.

18 Claims, 4 Drawing Sheets

WAY-GUIDANCE MARKER

This application claims the benefit of Provisional Application No. 60/628,896, filed on Nov. 17, 2004.

This invention relates to a way-guidance marker and more specifically to a way-guidance marker for utilization with a fibrous web surface.

Installation of way-guidance marker systems is increasingly recognized as an important component of commercial buildings, passenger vehicles, planes, and ships as fire safety professionals, architects, and designers become more aware of the importance of guiding the safe egress of occupants in the absence of normal lighting or the reduction of vision caused by smoke or other optical irritants.

It is common for many way-guidance markers to be installed in a mechanical channel or made of a contrasting photo-luminescent fiber which is integral with a fibrous material, such as a floor covering. Typically, the way-guidance markers or the photo-luminescent fiber is installed at the time of construction of the enclosed area. This is because the mechanical channels and photo-luminescent fiber require a major refitting of the interior, increasing installation cost and service interruption of the enclosed area.

Another method of installing way-guidance markers is to use an adhesive on the back of the markers and adhere the markers to a surface. However, markers using an adhesive backing tend to become dislodged when used on a floor having a fibrous web surface, such as carpet.

Accordingly, there is a need for a way-guidance marker that can be installed on a carpeted or other fibrous web floor easily, inexpensively, and securely.

SUMMARY OF THE INVENTION

Therefore, it is an object of the invention to provide a way-guidance marker that can be installed on a carpeted or other fibrous web surface.

It is another object of the invention to provide a way-guidance marker that can be installed without the use of tools.

It is another object of the invention to provide a way-guidance marker that can be installed on an existing carpeted or other fibrous web surface inexpensively.

It is another object of the invention to provide a way-guidance marker that will securely attach to a carpeted or other fibrous web surface.

These and other objects of the present invention are achieved in the preferred embodiments disclosed below by providing a guidance marker for providing an individual with a safe egress to an exit, including a base carrying an identifiable indicator surface; and at least one lock pin for securing the base to a fibrous web surface.

According to another preferred embodiment of the invention, the indicator surface is identifiable in the absence of normal lighting.

According to another preferred embodiment of the invention, the base includes at least one longitudinal slot for receiving the lock pin.

According to another preferred embodiment of the invention, the indicator surface includes a photo-luminescent material.

According to another preferred embodiment of the invention, the photo-luminescent material is a paint.

According to another preferred embodiment of the invention, the indicator surface is applied to the base by an adhesive.

According to another preferred embodiment of the invention, a guidance marker for providing an individual with a safe egress to an exit includes a base having at least one longitudinal slot; a lock pin for securing the base to a fibrous web surface, wherein the pin is adapted to engage the at least one longitudinal slot and the fibrous web surface; and a cap secured to the base. The cap includes an indicator surface which is identifiable in the absence of normal lighting and a downwardly-projecting rim for embedding into the fibrous web surface to prevent dislodgment.

According to another preferred embodiment of the invention, the downwardly-projecting rim extends outwardly at an angle from the indicator surface to form a recess for receiving the base.

According to another preferred embodiment of the invention, the recess is larger at a bottom edge of the rim than at the indicator surface to allow the base and indicator surface to come into contact with each other and to allow the bottom edge of the rim to embed into the fibrous web surface and prevent dislodgment.

According to another preferred embodiment of the invention, the lock pin includes generally parallel upper and lower portions connected by an end portion.

According to another preferred embodiment of the invention, the lower portion is adapted to engage the fibrous web surface and the upper portion is adapted to engage the at least one longitudinal slot, the base being compressed against the fibrous web surface between the upper and lower portions.

According to another preferred embodiment of the invention, the lower portion includes a chamfered end positioned opposite the end portion, and the upper portion includes a downwardly-extending tang extending downward from the distal end of the upper portion.

According to another preferred embodiment of the invention, the base includes an aperture positioned substantially in a center of the base for receiving the downwardly-extending tang and allowing the upper portion to engage the at least one longitudinal slot.

According to another preferred embodiment of the invention, a method for installing a guidance marker, the method including the steps of providing a guidance marker having a base, at least one lock pin, and an indicator surface; pressing the base against a resilient fibrous web surface; securing the base to the fibrous web surface using the lock pin; and releasing the base to allow the base to move upwardly and engage the lock pin.

According to another preferred embodiment of the invention, the method further including the step of securing the indicator surface to the base.

According to another preferred embodiment of the invention, the step of securing the indicator surface to the base includes the step of applying an adhesive to a bottom of the indicator surface and pressing the indicator surface against the base to allow the adhesive to bond the indicator surface to the base.

According to another preferred embodiment of the invention, the step of securing the base to the fibrous web surface includes the step of pushing a lower portion of the lock pin into the fibrous web surface until an end portion of the lock pin rests against an edge of the base and an upper portion of the lock pin engages the base.

BRIEF DESCRIPTION OF THE DRAWINGS

The invention may be best understood by reference to the following description taken in conjunction with the accompanying drawings, in which.

DESCRIPTION OF THE PREFERRED EMBODIMENT AND BEST MODE

Figure 1:
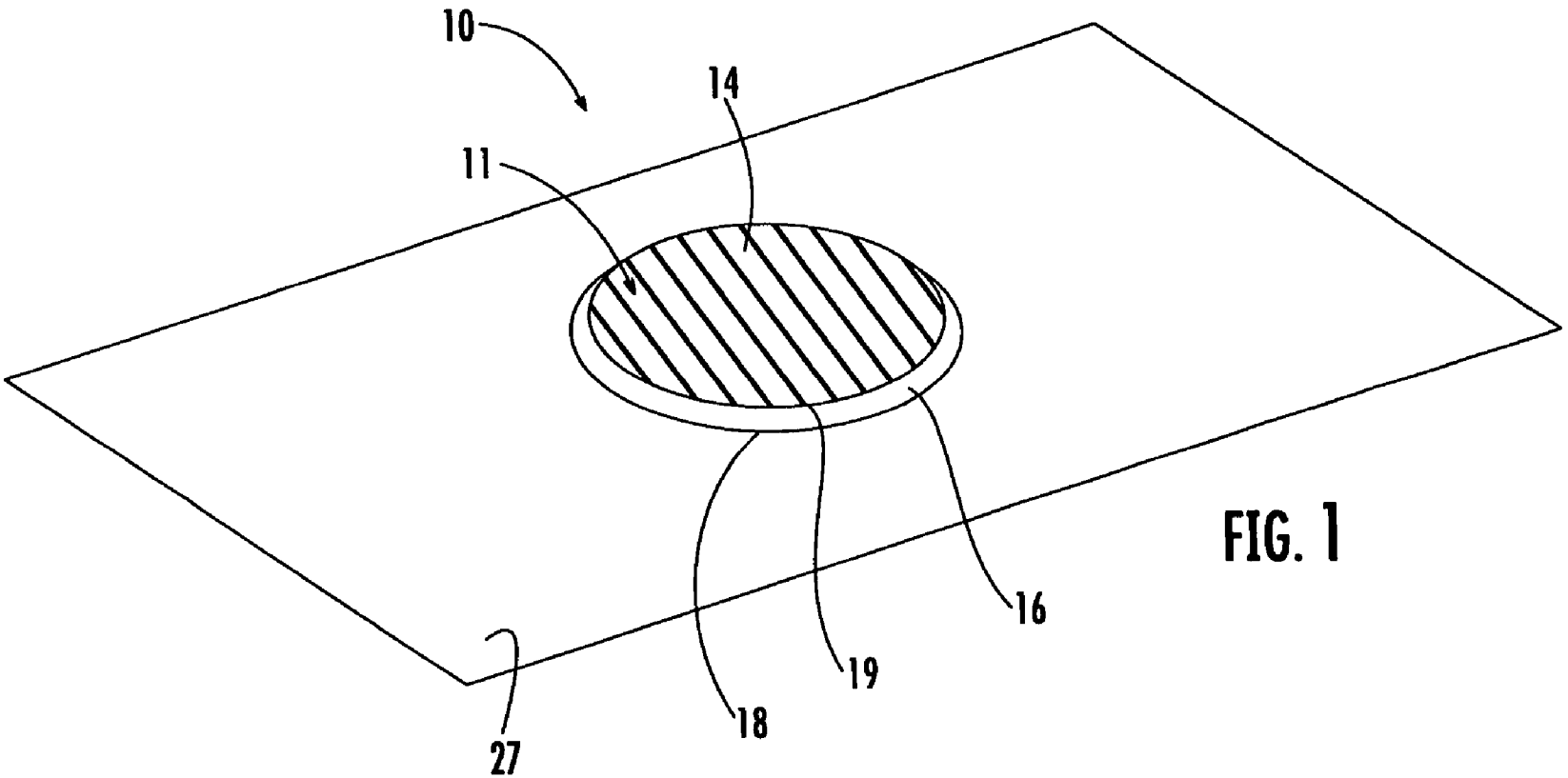
FIG. 1 is a perspective view of a way-guidance marker attached to a fibrous web surface according to a preferred embodiment of the invention.
Figure 2:
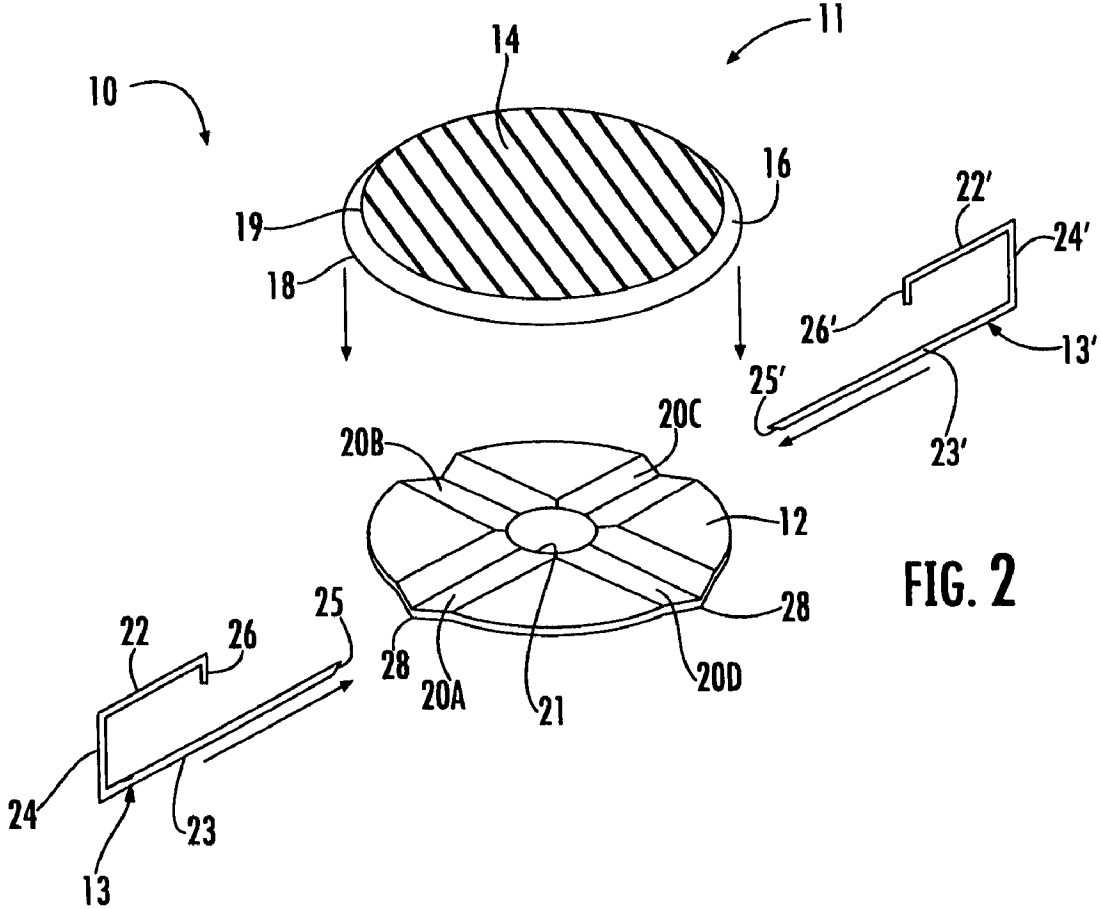
FIG. 2 is an exploded view of the way-guidance marker of FIG. 1.
Figure 4:
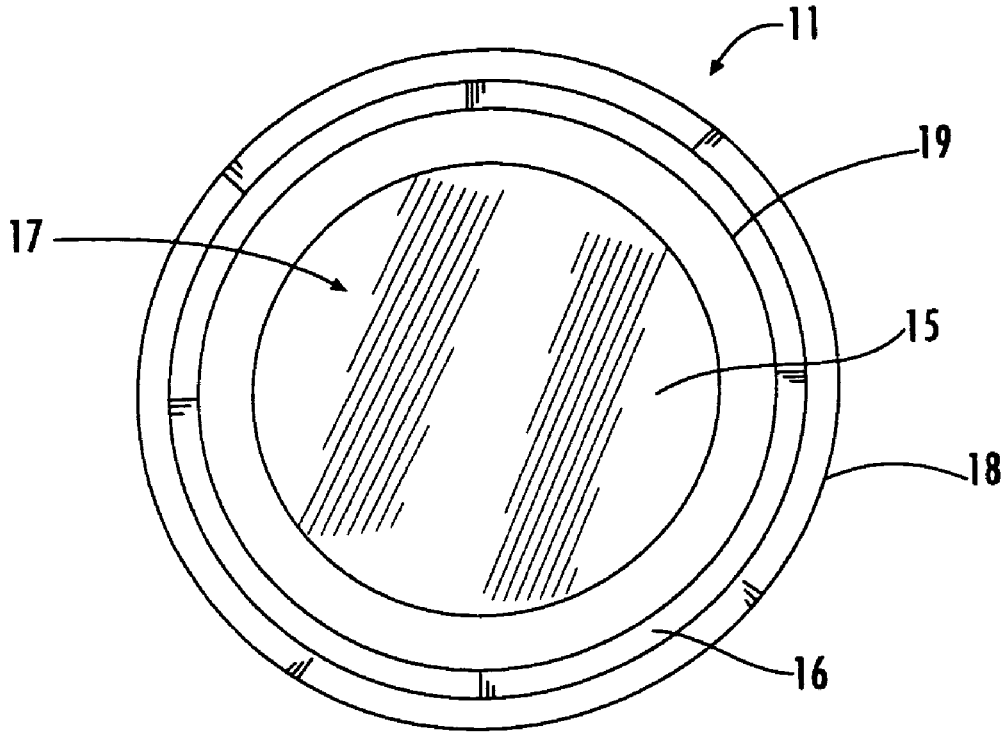
FIG. 4 shows the bottom side of a photo-luminescent cap of the way-guidance marker of FIG. 1.

Referring now specifically to the drawings, a way-guidance marker according to an embodiment of the present invention is illustrated in FIGS. 1 and 2 and shown generally at reference numeral 10. The marker 10 includes a photo-luminescent cap 11 secured to a base plate 12 which is secured to a fibrous web surface, such as carpet 27, by at least one lock pin 13. In the illustrated example, two lock pins 13 and 13' are used. The cap 11 includes an identifiable indicator surface 14 and an integrally-molded downwardly-projecting rim 16. The indicator surface 14 may be any material which provides a marking which is discernable by a human. Examples of suitable indicator surfaces include painted or molded colored surfaces, printed, molded or painted indicia, and raised textures. Preferably the indicator surface is identifiable under low-visibility conditions. In the illustrated example the indicator surface 14 comprises a plate embedded into the cap 11, the upper surface of which is a photo-luminescent material of a known type. As shown in FIG. 4, the rim 16 projects both downwardly and outwardly at an angle from the bottom side of the indicator surface 14 to form a recess 17 that has a diameter larger at a bottom edge 18 of the rim 16 than at its cap edge 19. An adhesive pad 15 is disposed on the bottom side of the cap 11, opposite the indicator surface. It should be appreciated that the photo-luminescent cap may be of various shapes and sizes, for example, a long strip.

Referring again to FIG. 2, the base plate 12 includes four longitudinal V-shaped slots 20A-20D. As illustrated, each of the slots 20A-20D is positioned at a 90 degree angle from an adjacent slot to form a cross-shaped pattern, and extends from an outer edge of the base plate 12 to an opening 21 positioned in the center of the base plate 12. It should be appreciated that the number of slots, the shape of the slots, and the angle between adjacent slots may be varied for use in different environments.

The lock pin 13 has generally parallel upper and lower portions 22 and 23 connected by an end portion 24. The lower portion 22 has a chamfered end 25 disposed opposite the end portion 24. A downwardly-extending tang 26 extends downward from the distal end of the upper portion 22. The lock pin 13' is identical in construction to the lock pin 13, with upper and lower portions 22' and 23', end portion 24', chamfered end 25', and tang 26'.

Figure 3:
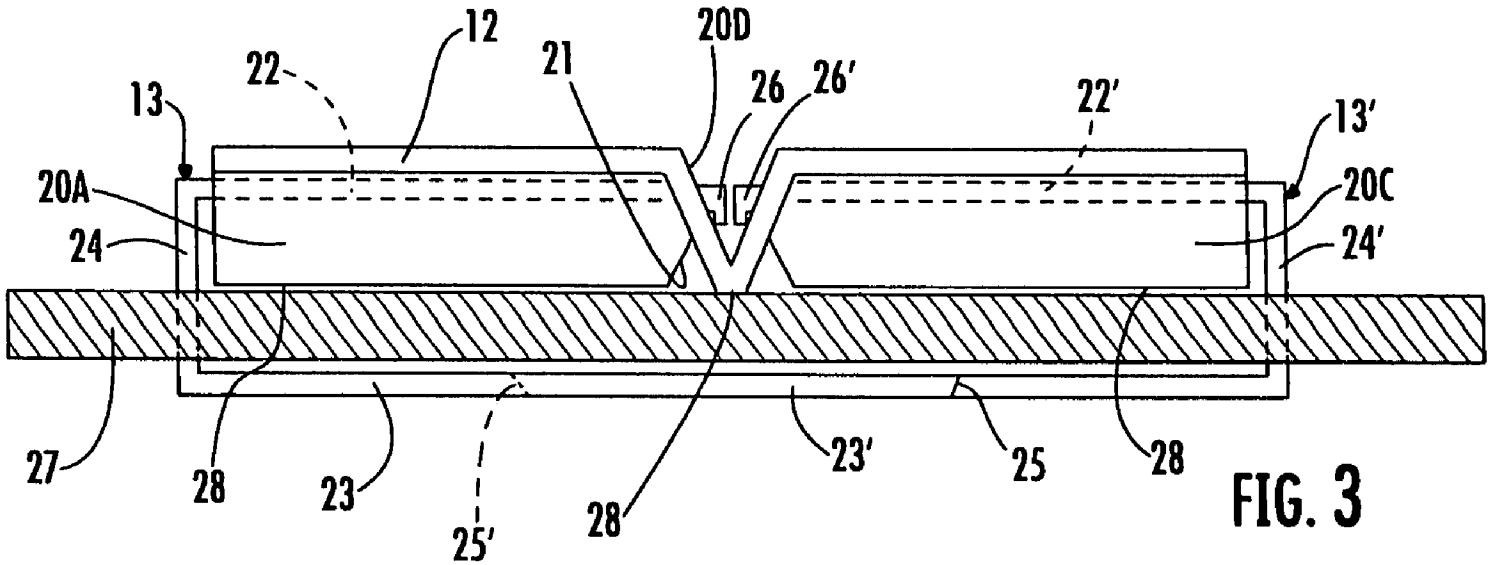
FIG. 3 shows a base plate of the way guidance marker of FIG. 1 attached to a fibrous web surface.

Referring to FIGS. 2 and 3, the base plate 12 is securely fastened to a piece of carpet 27 or other fibrous web surface by positioning the base plate 12 in a manner so that the bottom edges 28 of the slots 20A-20D are pressed against the carpet 27. The chamfered end 25 of the lower portion 23 of the lock pin 13 is then inserted into the carpet 27, and the upper portion 22 is positioned into the slot 20A. The lock pin 13 is then pushed along the carpet 27 and slot 20A until the end portion 24 resides next to the outer edge of the base plate 12. The chamfered end 25' of the lower portion 23' of the lock pin 13' is then inserted into the carpet 27, and the upper portion 22' is positioned into an opposing slot 20C. The lock pin 13' is then pushed along the carpet 27 and slot 20C until the end portion 24' resides next to the outer edge of the base plate 12. Once the lock pins 13 and 13' are in position, the base plate 12 is released to allow the compressed carpet 27 to return to form, causing the slots 20A and 20C to press upwards against the lock pins 13 and 13' and allowing the tangs 26, 26' to extend into and engage the opening 21, preventing the lock pins 13 and 13' from disengaging the base plate 12 and carpet 27. Additionally, the end portions 24, 24' of the lock pins 13, 13' reside against the carpet 27, preventing the lock pins 13 and 13' from disengaging the base plate 12 and allowing the base plate 12 to disengage the carpet 27. As illustrated only two lock pins 13 and 13' are used to secure the base plate 12 to the carpet 27, however, as many as four lock pins may be used with the illustrated based plate 12.

To remove the base plate 12 from the carpet 27, the base plate 12 is pressed against the carpet 27, releasing the tangs 26, 26' from engagement with the opening 21, allowing the lock pins 13, 13' to be pulled out of the carpet 27 and slots 20A and 20C by pulling the lock pins 13, 13' up and out.

As shown in FIG. 2, the cap 11 is positioned on top of the base plate 12 and secured by an adhesive positioned on the bottom side of the indicator surface 14, allowing the adhesive to make contact with a flat non-fibrous surface and provide a strong bond between the cap 11 and the base plate 12. The diameter of the base plate 12 is substantially equal to the diameter of the indicator surface 14 and less than the diameter of the bottom edge 18 of the rim 16 to allow the base plate 12 to come into contact with the adhesive, and to allow the rim 16 to surround and conceal the base plate 12 while allowing the bottom edge 18 to come into contact with and embed into the carpet 27. The slope of the rim 16 provides a smooth non-catch surface that in combination with embedding the bottom edge 18 into the carpet 27 prevents the cap 11 from being dislodged or removed from the base plate 12 through normal wear and tear.

A way-guidance marker is described above. Various details of the invention may be changed without departing from its scope. Furthermore, the foregoing description of the preferred embodiment of the invention and the best mode of practicing the invention are provided for the purpose of illustration only and not for the purpose of limitation.

I claim:

1. A guidance marker for providing an individual with a safe egress to an exit, comprising:

(a) a base carrying an identifiable indicator surface; and (b) at least one lock pin having a first pin portion and a second pin portion for securing the base to a fibrous web surface, the first pin portion having a length equal to about half the distance across an upper surface of the base such that a distal end of the first portion resides at about a center of the base when in a secured position to allow multiple lock pins to be used to secure the base without overlapping, wherein the first pin portion engages the upper surface of the base and the second pin portion engages the fibrous web surface such that the base is compressed against the fibrous web surface between the first pin portion and the second pin portion.

2. The guidance marker according to claim 1, wherein the indicator surface is identifiable in the absence of normal lighting.

3. The guidance marker according to claim 1, wherein the base includes at least one longitudinal slot for receiving the first pin portion of the lock pin.

4. The guidance marker according to claim 3, wherein the longitudinal slot is a v-shaped groove to allow the first pin portion to slide over the base and be contained therein such that when the base is in a secured position, the first pin portion does not interfere with the plane of the upper surface.

5. The guidance marker according to claim 1, wherein the indicator surface includes a photo-luminescent material.

6. The guidance marker according to claim 5, wherein the photo-luminescent material is a paint.

7. The guidance marker according to claim 1, wherein the indicator surface is applied to the base by an adhesive.

8. A guidance marker for providing an individual with a safe egress to an exit, comprising:

(a) a base having at least one longitudinal slot;

(b) a lock pin having a first pin portion and a second pin portion for securing the base to a fibrous web surface, the first pin portion has a length equal to about half the distance across an upper surface of the base such that a distal end of the first pin portion resides at about a center of the base when in a secured position to allow multiple lock pins to be used to secure the base without overlapping, wherein the first pin portion is adapted to engage the at least one longitudinal slot and the second pin portion is adapted to engage the fibrous web surface such that the base is compressed against the fibrous web surface between the first pin portion and the second pin portion; and (c) a cap secured to the base, the cap having an identifiable indicator surface and a downwardly-projecting rim for embedding into the fibrous web surface to prevent dislodgment.

9. The guidance marker according to claim 8, wherein the indicator surface is identifiable in the absence of normal lighting.

10. The guidance marker according to claim 9, wherein the recess is larger at a bottom edge of the rim than at the indicator surface to allow the base and indicator surface to come into contact with each other and to allow the bottom edge of the rim to embed into the fibrous web surface and prevent dislodgment.

11. The guidance marker according to claim 8, wherein the downwardly-projecting rim extends outwardly at an angle from the indicator surface to form a recess for receiving the base.

12. The guidance marker according to claim 8, wherein the first pin portion and the second pin portion of the lock pin are generally parallel to each other and are connected by an end portion.

13. The guidance marker according to claim 12, wherein the second pin portion includes a chamfered end positioned opposite the end portion, and the first pin portion includes a downwardly-extending tang extending downward from the distal end of the first pin portion.

14. The guidance marker according to claim 13, wherein the base includes an aperture positioned substantially in a center of the base for receiving the downwardly-extending tang and allowing the first pin portion to engage the at least one longitudinal slot.

15. A method for installing a guidance marker, the method comprising the steps of:

(a) providing a guidance marker, having:

(i) a base;

(ii) at least one lock pin having a first pin portion and a second pin portion, the first pin portion has a length equal to about half the distance across an upper surface of the base such that a distal end of the first pin portion resides at about a center of the base when in a secured position to allow multiple lock pins to be used to secure the base without overlapping; and (iii) an indicator surface;

(b) pressing the base against a resilient fibrous web surface;

(c) securing the base to the fibrous web surface using the lock pin; and (d) releasing the base to allow the base to move upwardly and engage the lock pin.

16. The method according to claim 15, further including the step of securing the indicator surface to the base.

17. The method according to claim 16, wherein the step of securing the indicator surface to the base includes the step of applying an adhesive to a bottom of the indicator surface and pressing the indicator surface against the base to allow the adhesive to bond the indicator surface to the base.

18. The method according to claim 15, wherein the step of securing the base to the fibrous web surface includes the step of pushing the second pin portion of the lock pin into the fibrous web surface below the base until an end portion of the lock pin rests against an edge of the base and the first pin portion of the lock pin slides over and engages the upper surface of the base.

* * * * *